United States Patent [19]

Jagosz et al.

[11] Patent Number: 4,625,641

[45] Date of Patent: Dec. 2, 1986

[54] ENVELOPE PRINTING APPARATUS WITH SIDE ALIGNERS EXTENDING THROUGH A MOVEABLE ELEVATOR PLATFORM

[76] Inventors: Theodore T. Jagosz, 936 Second St., Hermosa Beach, Calif. 90254; David J. Tepe, 1646 Stanford Ave., Redondo Beach, Calif. 90278

[21] Appl. No.: 712,733

[22] Filed: Mar. 18, 1985

[51] Int. Cl.[4] ..... B61F 13/64

[52] U.S. Cl. ..... 101/240; 400/624; 271/2; 271/9; 271/236; 271/254

[58] Field of Search ..... 101/236–240; 400/605, 624, 625, 627; 271/2, 9, 15, 91, 94, 226, 234, 236, 240, 245, 248, 253–255

[56] References Cited

U.S. PATENT DOCUMENTS

| | | | |
|---|---|---|---|
| 1,180,652 | 4/1916 | King | 271/9 X |
| 1,564,937 | 12/1925 | Campbell | 400/627 |
| 3,146,902 | 9/1964 | Voelker | 271/2 |
| 3,373,989 | 3/1968 | Le Baron | 271/2 |
| 3,384,252 | 5/1968 | West | 271/2 |
| 3,890,185 | 6/1975 | Umazume | 271/9 X |
| 3,977,539 | 8/1976 | Hauschild | 271/9 |
| 4,176,832 | 12/1979 | Hughes et al. | 271/236 |
| 4,181,078 | 1/1980 | Davis | 101/240 |
| 4,348,018 | 9/1982 | Bijttebier et al. | 271/236 |
| 4,384,710 | 5/1983 | Gustafson | 271/9 |
| 4,451,191 | 5/1984 | Torre | 271/9 |
| 4,506,879 | 3/1985 | Goodwin et al. | 271/253 |

*Primary Examiner*—E. H. Eickholt
*Attorney, Agent, or Firm*—Paul D. Supnik

[57] ABSTRACT

Multiple simultaneous envelope duplicating apparatus has a windowed feed elevator supplying envelope stacks to an offset duplicator. The elevator has an open frame supporting a pair of spaced apart parallel envelope stack supporting plates. The plates and the frame define windows for receiving in vertically movable relationship, guide members to maintain the envelope stacks upright and in alignment with suction feet at a receiving station of the offset duplicator. A delivery end of the duplicator having a receding stacker also has an open frame supporting a pair of spaced apart envelope stack supporting plates to receive printed envelopes, and define windows for receiving in vertically movable relationship, a second set of guide members to maintain the printed envelope stacks upright. Upright member supporting bases are adjustable so that the guide members can be fitted to bound the sides of different sized envelopes. Bulk envelope chargers have envelope receiving side plates and a back retaining plate. The plate is movable in response to a plunger to cause a stack of envelopes to engage a region beneath the feed station of the offset press and on the envelope stack supporting plates to bulk feed envelopes.

In operation, after loading envelopes by the charger, two envelope stacks move upward to the feed region where suction feet strip the top envelopes of the stacks simultaneously feeding in alignment two envelopes to the printing path of the offset press. The guide members retain the stacks in an upright position, the frame being allowed to pass upward without interference by the guide members.

19 Claims, 12 Drawing Figures

ENVELOPE PRINTING APPARATUS WITH SIDE ALIGNERS EXTENDING THROUGH A MOVEABLE ELEVATOR PLATFORM

BACKGROUND OF THE INVENTION

1. Field of the Invention

This invention pertains to envelope printing apparatus. More particularly this invention pertains to a feeding and delivery system for multiple simultaneous printings of envelopes retrofit to use ordinary offset duplicators.

2. Background of the Prior Art

There is a continuing demand for envelope imprinting. Printing may be accomplished, among other ways, by engraving, typesetting and by offset. Offset duplicator production is desirable as it is inexpensive to create a master, set up is rapid, and substantial press runs can be made at low cost. However, several barriers prevent more widespread use of ordinary offset duplicators to print envelopes.

The ordinary envelope, such as the business envelope, otherwise commonly known as a number 10 envelope, has two thicknesses in most portions, but as many as four thicknesses of paper along portions where the flap is sealed, in addition to a further thickening and stiff curvature resulting from the gummed lip. When envelopes are stacked, they do not stack evenly as ordinary paper. Once stacked, they are not likely to maintain their upright position in the stack. This instability results from the relationship of the relatively small width of the envelope to the significantly greater height of the envelope stack. For a stack of, for example, a thousand envelopes, the stack exhibits instability and does not stand up straight. That instability is not present in a stack of, for example, one thousand sheets of 20 weight $8\frac{1}{2}'' \times 11''$ (21.6 cm.×28 cm.) paper. The instability of envelope stacks is a result both of the rectangularity of the envelopes and the relationship of the area of the envelope to the height of the stack, in addition to the aforementioned variations in envelope thickness.

Additional problems arise when printing envelopes in multiple colors. A separate print run generally must be made for each color ink (unless additional cylinders) are available in the offset duplicator). Each subsequent run requires that the envelopes to be printed be aligned so that the printing of the subsequent color impression is in registration with the previous print of the first color. This registration requires control over the manner in which the envelopes are fed to the printing path of the printing cylinders.

The feed and delivery systems of ordinary offset duplicators tend to be designed for ordinary flat paper which stacks up evenly. Envelopes, such as the usual number 10 business envelope, may not generally be run on ordinary offset presses without unusual careful and time consuming procedures.

There are offset duplicators that are specifically designed for printing envelopes. However, they are expensive. It is generally not economical to dedicate a special high cost offset duplicator for running printing jobs of envelopes. Consequently, the number of such machines is small and they are not within the means of the typical print shop.

Accordingly, it would be beneficial to provide a relatively low cost apparatus for allowing envelopes to be rapidly printed using an ordinary offset duplicator otherwise designed primarily for printing an ordinary flat rectangular paper.

SUMMARY OF THE INVENTION

An envelope printing system in accordance with this invention generally includes feeding apparatus for presenting multiple envelope stacks simultaneously to an offset duplicator of the type having an elevator for progressively feeding sheet media to a nominally fixed level receiving station for feeding to a printing path. A platform frame having envelope plates spanning the frame is attached to the elevator of the offset duplicator. The plates are spaced apart to define windows. A base beneath the frame supports upright guide members which extend upward through the windows. The guide members pass through the windows as the frame and elevator move along a vertical axis to present envelopes to the feed station, maintaining the envelope stacks uniform and upright for presentation to the receiving station.

More specifically, the feeding system has a guide member arrangement including interior guide members for supporting adjacent juxtaposed envelope stacks, remotely spaced apart outer guide member means for inwardly retaining the two juxtaposed envelope stacks, and forward guide member means for directing the positioning of the envelopes reaching the receiving station. A receding stacker arrangement includes a stacker base having upright stacker members and a stacker bed.

Additional features in accordance with this invention include adjustable guide members arrangements for adjusting the positioning of the various guide members according to envelope size. A charger arrangement disposed adjacent to the feed arrangement provides for bulk delivery of an envelope stack to allow substantially continuous feeding of envelopes to be printed.

BRIEF DESCRIPTION OF THE DRAWINGS

The nature of the invention described herein may be best understood and appreciated by the following description taken in connection with the accompanying drawings in which.

DETAILED DESCRIPTION

Figure 1:
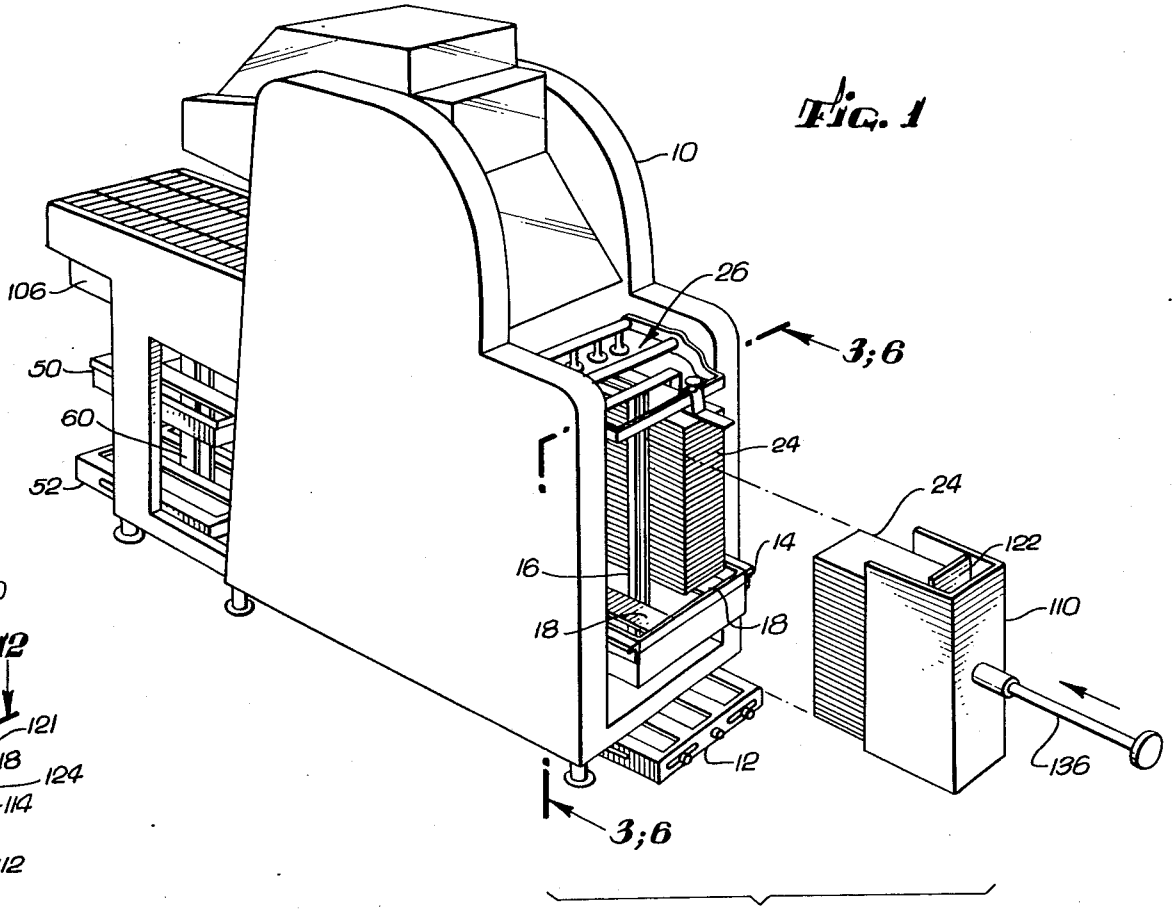
FIG. 1 is a diagrammatic perspective view of envelope printing apparatus in accordance with this invention.

With particular reference to FIGS. 1, 2, 3, 4, 5, 6, 7 and 8, an example of an envelope printing system in accordance with this invention generally comprises an offset duplicator 10 having a feed system comprising a base 12 disposed beneath a feed elevator frame 14 and a guide member arrangement 16 extending upright from the base 12 and through the elevator frame 14. The frame 14 supports an envelope bed arrangement comprising two parallel envelope support plates 18 disposed along a common plane in a spaced apart relationship. The frame 14 and the support plates 18 define windows 20, 22 for receiving the guide member arrangement 16 to uniformly retain spaced apart juxtaposed stacks of envelopes 24 as the envelopes 24 travel upwardly to a media receiving station 26.

Figure 6:
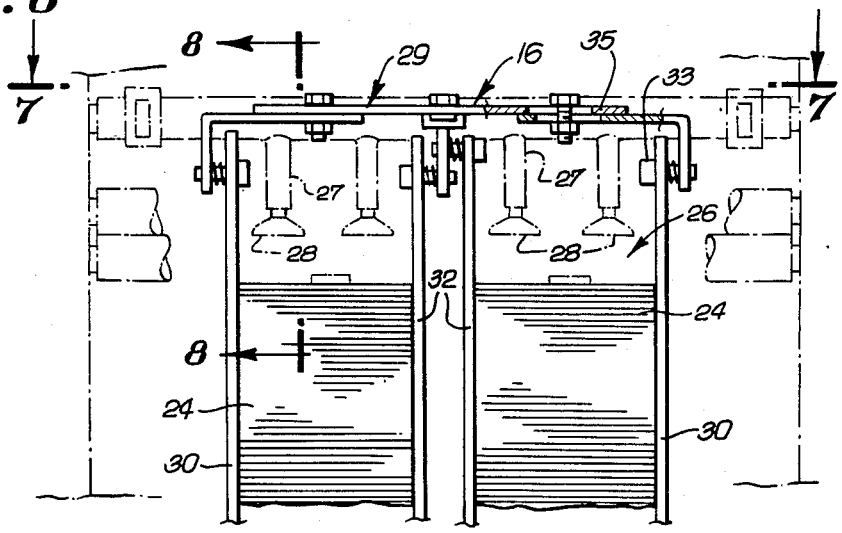
FIG. 6 is an section view taken along lines 6—6 of FIG. 1.
Figure 7:
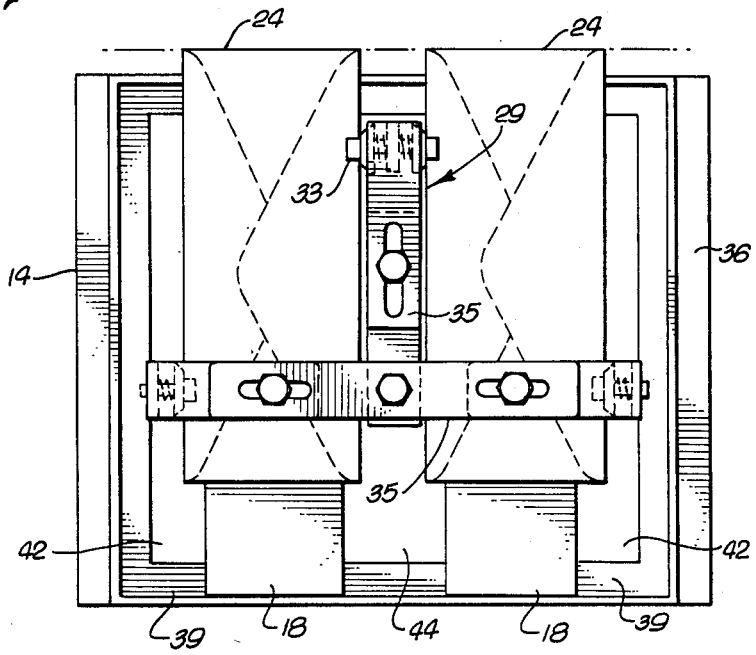
FIG. 7 is an section view taken along lines 7—7 of FIG. 6.
Figure 8:
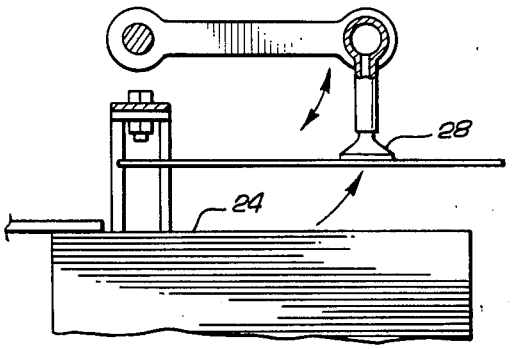
FIG. 8 is an section view taken along lines 8—8 of FIG. 6.

At the media receiving station 26, suction feet 28 strip off the top envelopes 24 as viewed in FIGS. 6 and 8. The suction feet 28 as commonly used in such offset duplicators 10, typically comprise nine spaced vacuum coupled fingers 27 shown diagrammatically as 4 fingers in FIG. 6. After the top two envelopes are stripped, they are then transported through to cylinders of the duplicator by a series of pincing grippers (now shown).

Figure 2:
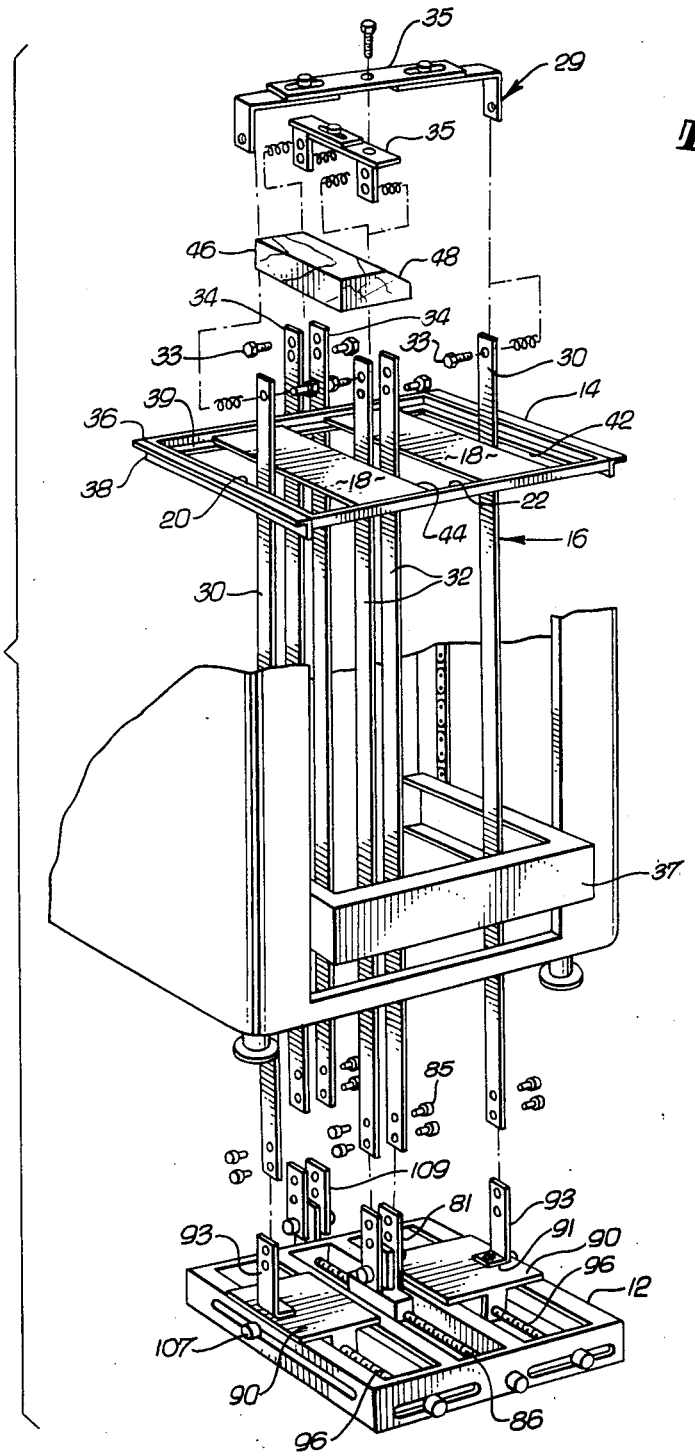
FIG. 2 is an exploded perspective view with portions exposed and removed of the apparatus depicted in FIG. 1.
Figure 5:
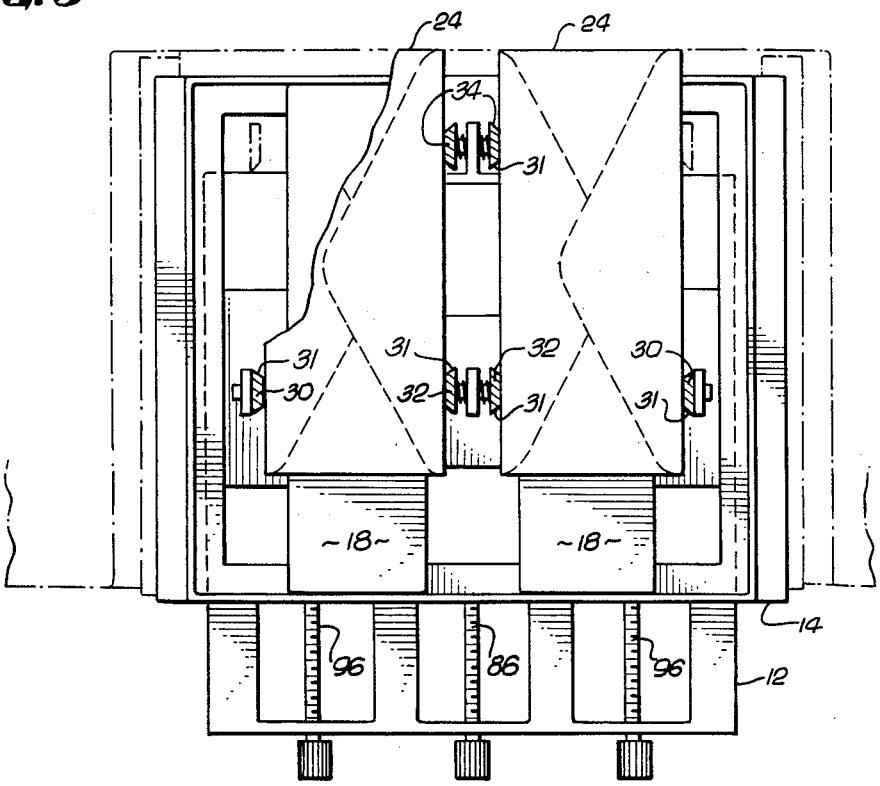
FIG. 5 is an section view taken along lines 5—5 of FIG. 3.

The guide member arrangement 16 comprises rearward outer guide members 30 for inwardly retaining envelope stacks, rearward inner guide members 32 for outwardly retaining the envelope stacks, forward guide members 34 for spacing and directing envelope stacks and a linkage assembly 29 for joining the guide members above the stacks of envelopes 24. As shown in FIG. 2 and FIG. 5, the outer and inner guide members 30, 32 are positioned adjacent the back third of the envelope length to provide suitable control over the envelope position to align the envelopes normal to the media receiving station 26. Forward guide members 34 are disposed upright between adjacent the suction feet of the media receiving station 26 and the rearward outer and inner guide members 30, 32. As viewed in FIG. 5, the guide members 30, 32, 34 have beveled edges 31 for receiving and guiding envelopes easily as they are stacked between the guide members. The upper linkage assembly 29 provides a structural rigidity for the guide member arrangement 16. The assembly 29 comprises spring loaded fasteners 33 and adjustable fastenably longitudinally apertured plates 35, allowing the linkage assembly 29 to be enlarged or contracted depending upon the desired spacing between the guide members, according to the size of the envelope to be printed.

The frame 14 is generally rectangular having a flat outer portion 36 joined to the feeding elevator 37 of the offset duplicator 10 and an upright perimeter portion 38. Spaced apart and laterally disposed along a common plane are inwardly directed opposing plate support surfaces 39. The pair of rectangular stack support plates 18 are placed in the frame within the upright perimeter portion 38 and supported by the support surfaces 39. The support plates 18 are disposed along a common plane in a parallel spaced apart relationship and define outer windows 42 between the plates 18 and the frame 14 and the inner window 44 between the two plates 18. The plates 18 are movable within the frame 14 along the common plane defined by the support surfaces 39 to allow positioning according to the particular sizes of the envelopes 24 to be printed. The windows 42, 44 provide clearance to allow the elevator 37 and frame 14 to be moved vertically without interference by the guide member arrangement 16 which passes through the windows 42, 44. A pair of rectangular blocks 46, each has a rectangular longitudinally disposed oblique surface 48. The blocks 46 are longitudinally disposed along the support plates 18, the oblique surface 48 defining a plane at an acute angle to the plane of the support plates 18. The blocks 46 raise the envelope stack 24 so that all envelopes in the stack may be received by the offset duplicator 10 for printing and the oblique surface 48 provides an overhang region for the sides of envelopes resulting from the overhang effect of uneven envelope thicknesses. This is best viewed in FIG. 3 and FIG. 2 (where a single block 46 is shown).

Figure 9:
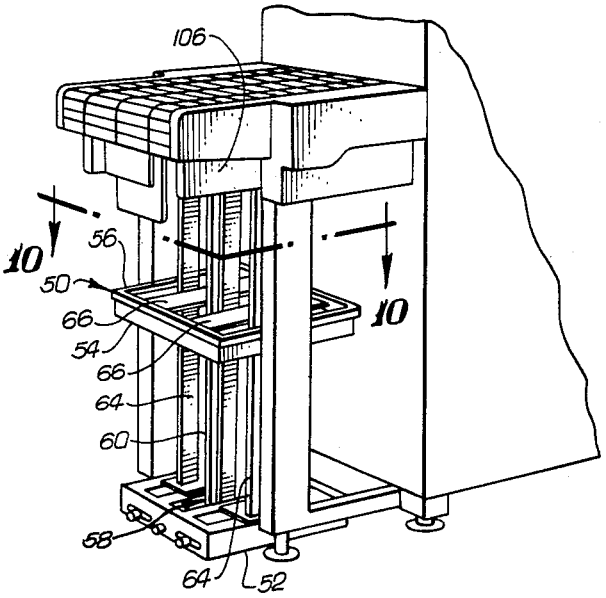
FIG. 9 is a perspective view of a portion of the invention depicted in FIG. 1.
Figure 10:
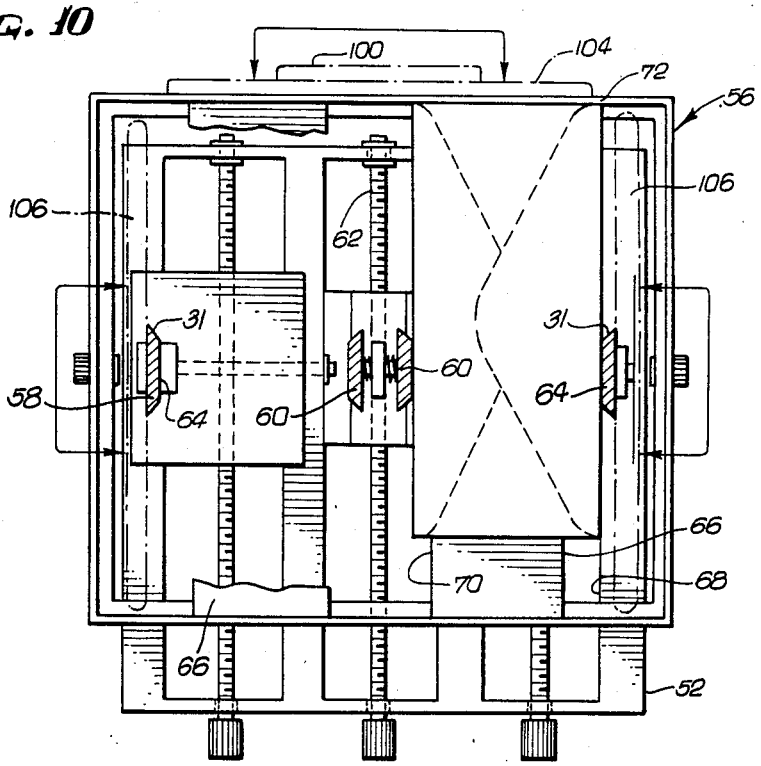
FIG. 10 is a section view taken along lines 10—10 of FIG. 9.

As viewed in FIG. 9 and FIG. 10, the duplicator system 10 further includes delivery apparatus 50 for collecting the envelopes as they are delivered by the offset duplicator 10. The delivery apparatus 50 comprises a base 52 disposed beneath a receding elevator yolk 54 supporting a rectangular frame 56. A guide member arrangement 58 extends upright from the base 52 and through the frame 56. The guide member arrangement 58 comprises two juxtaposed opposing outwardly distributed central upright members 60 movable longitudinally along a threaded track 62 in the base 52 and two spaced apart upright guide members 64 adjustably movable both longitudinally and laterally to adjust for the use of different sized envelopes. The frame 56 supports two parallel envelope support plates 66 disposed in a spaced apart relationship. The frame 56 and the support plates 66 define windows 68, 70 for receiving the guide member arrangement 58 to uniformly retain stacks of printed envelopes 72 as they are stacked on the delivery elevator frame 56.

Figure 3:
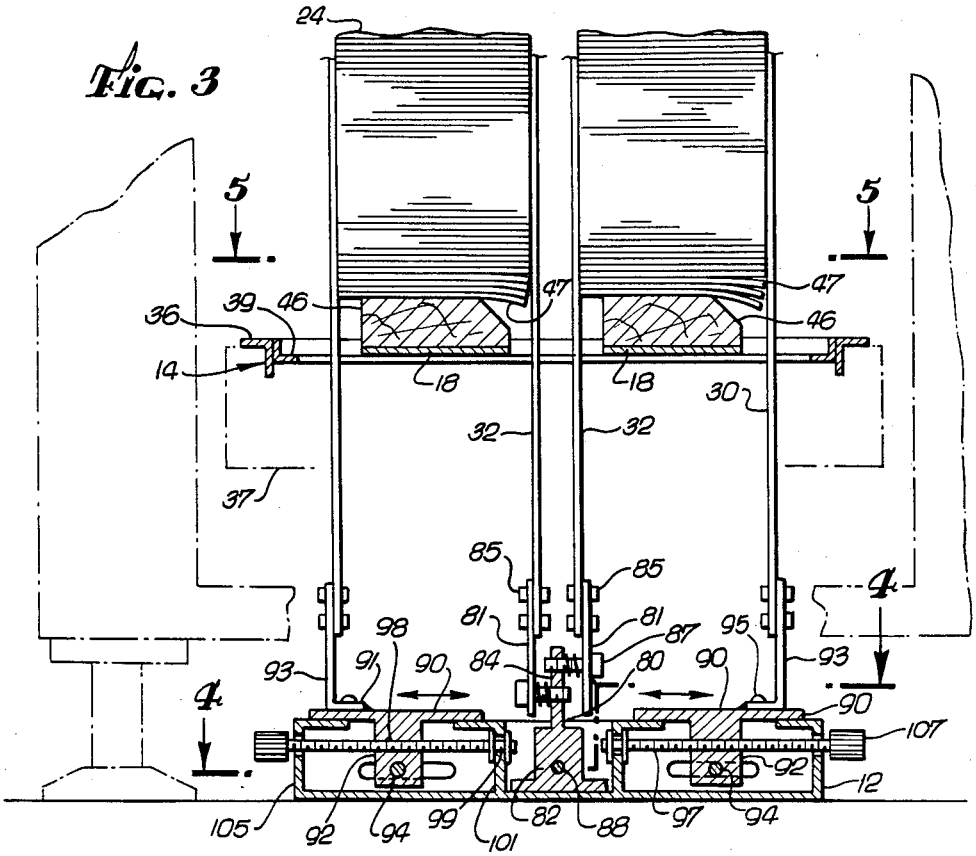
FIG. 3 is a section view taken along lines 3—3 of FIG. 1.
Figure 4:
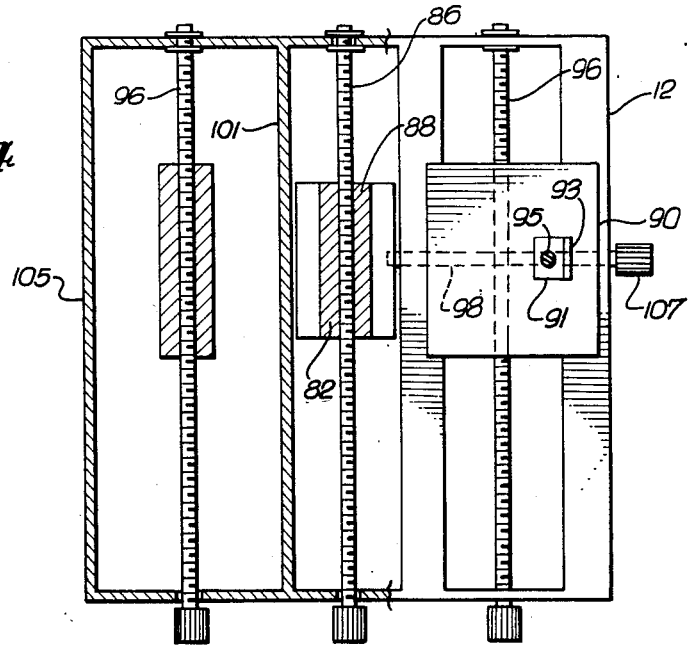
FIG. 4 is an section view taken along lines 4—4 of FIG. 3.

As shown in FIGS. 3 and 4, the base 12 comprises a central track 80 and a movable base element 82 having an upright portion 84 extending upward through and movable along the track 80. Upright fingers 81 joined to the upright portion 84 of the base element 82 are joined to the inner upright members 32. Bolts 85 and spring loaded fasteners 87 adjustably couple to the lower portions of the members 32 to the fingers 81. It should be recognized that the guide members 32 may be joined directly to the base element 82 and the upright fingers 81 need not be present.

A threaded longitudinal bolt 86 is disposed parallel to the track 80 and beneath the track 80. The base element 82 has a central thread 88 mating with the bolt 86 and extending through the base element 82. The bolt 86 is rotatable for adjusting the longitudinal position of the base element 82, and hence the position of the upright guide members 32 coupled to the base element 82 through the upright fingers 81.

A pair of lateral tracking plates 90 having downwardly directed lugs 92 are disposed in spaced apart relationship on the base 12 on both sides of the base element 82. The lugs 92 have an internal threaded apertures 94 and the threaded bolts 96 disposed within each aperture 94 couple the lugs 92 to the base 12 in a threaded rotatably movable relationship. The lateral tracking plates 90 have L brackets 91 attached with upright fingers 93 joined to upright support members 30. The tracking plates 90 provide for longitudinal movement of the outer upright guide members 30. In addition, the L brackets 91 may be moved closer toward the central portion of the base 12 by removal of screws 95 fastening the L brackets 91 to the lateral support plates 90. That provides adjustment for various width envelopes. Transverse adjustment is further facilitated by transverse bolts 97 extending through a threaded aperture 98 in the base element lugs 92 and normal to the threaded aperture 94. The bolts 97 have smooth portions 99, not threaded, joined to upright inner ledges 101 of the base 12 through a ledge aperture to allow free rotation without transverse movement of the bolts 97. Similarly, the bolts 97 are coupled to the outer sides 105 of the base 12 with a knob attachment 107. This allows rotation of the knob 107 coupled to the bolts 97 to provide further transverse adjustment of the lateral tracking plates 90, and hence adjustment of the outer upright support members 30. The forward guide members 34 are joined to the base 12 through upright fingers 109 at the forward portion of the base 12. The base 52 has a similar arrangement for movably and adjustably coupling the guide members 60, 64 to the base 52 as viewed in FIG. 10.

Back joggers 100 as viewed in FIG. 10 are provided in the offset duplicator 10 are used to maintain the stacks of printed envelopes 72 in even stacks after printing. Since two stacks of printed envelopes 72 are to be stacked, rather than a single stack of printed sheet paper, the region over which the back joggers 100 exert a tamping movement on the envelopes may require a larger or multiple regions to cover the widths of the envelopes 72. Typically the back joggers 100 supplied with the offset duplicators engage a narrow portion of the paper stack. In order to have the back jogger engage two stacks of envelopes, the size of which may vary from time to time, an adjustable enlargement plate 104 is joined to the jogger 100. Thus, motion of the joggers is transmitted through the enlargement plate 104 to cover the width of both envelopes.

Side joggers 106 are disposed within the duplicator for normally lining up a single stack of printed paper as delivered by the duplicator 10. The side joggers 106 are typically about 4 inches (10.2 cm.) high and 14 inches (35.6 cm.) long and come in contact with the tops of the sides of the upright longitudinal guides members, which straighten the two envelope stacks 24.

Figure 11:
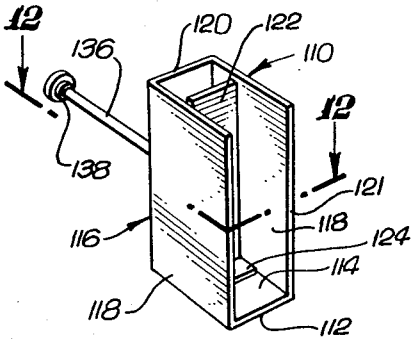
FIG. 11 is a perspective of a portion of the invention depicted in FIG. 1.
Figure 12:
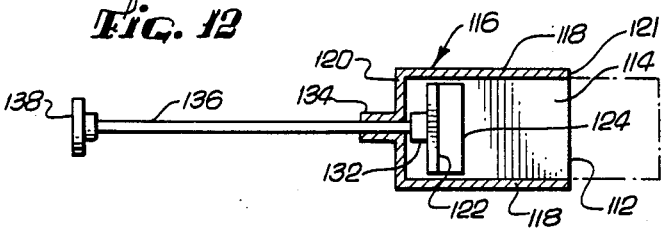
FIG. 12 is a section view taken along lines 12—12 of FIG. 11.

A pair of chargers 110 as best viewed in FIGS. 1, 11 and 12, provide for easily and rapidly loading the stacks of envelopes 24 into the region between the feeding elevator frame 16 and the media receiving station 26. Each charger 110 comprises a base plate 112 having an upper surface 114 for receiving a stack of envelopes 24. An upright U shaped channel 116 is disposed on and normal to the base plate 112. The channel 116 defines a pair of facing parallel upright side containment portions 118 and a rear portion 120 normal to the side containment portions 118. The U shaped channel 116 defines a front edge 121 which engages the offset duplicator 10 when used. Spaced apart from the front edge, toward the rear portion 120 is an upright moveable vertical plate 122 confined within the U shaped plate 116 and in parallel spaced relationship to the rear portion. The vertical plate 122 has, at its lower portion, an envelope supporting flange 124 laterally disposed and forwardly extending towards the front edge 121.

A plunger arrangement has an anchoring portion 132 fixed to the moveable vertical channel 122 and a guide coupling 134 extending through to the rear portion 120 of the U-shaped plate 116. A plunger 136 has a handle 138 extending outwardly of the rear portion 120. Once the plunger 136 is moved forward, the vertical plate 122 pushes a stack of envelopes 24 disposed on the charger 110, to the feed system 26.

A typical duplicator 10 may be modified or retrofit for use in accordance with this invention by simply the removal of the generally solid elevator top of the feeding region to provide a clear area to support the frame 14. Similarly the top of the dolly of the delivery region is slipped out and replaced by the frame 56 frame to allow the guide member arrangement 58 to pass through the frame 56. While not shown in FIG. 9, it should be noted that the delivery elevator of a typical offset duplicator 10 has a dolly with wheels at the bottom for rapidly removing printed matter, which are suitable for use in accordance with this invention.

In operation, the base 12 of the feed system and the base 52 of the delivery system are adjusted for the size of the envelope to be printed. Thus, the tracking plates 90 are adjusted by rotation of the threaded bolts 96 and by either adjustment of the screws 95 to change the lateral position of the upright members 83 or by the transverse bolts 97 by rotation of the knob attachment 107.

The linkage assembly 29 is adjusted by loosening the spring loaded fasteners 33 and adjusting the length of the longitudinal apertures plates 35, so that the upright members 30, 32 conform to the width of the envelopes.

Similarly, upright members 60, 64 of the delivery guide member arrangement 58 are adjusted to provide appropriate clearance for the width of the envelopes to be printed. The base 52 is similarly adjusted.

Wooden blocks 46 having oblique surfaces 48 are placed on the support plates 18, 66 of the frames 14, 56 to compensate for the extra thickness caused by the flaps and seams of the stacked envelopes 24, 72. Envelopes have as many as four thicknesses of paper along the inwardly directed sealing edges. Thus there is at only some locations, a double thickness which prevents the envelopes from stacking up evenly. The oblique surfaces 48 of the blocks 46 provide a clearance region, allowing envelope overhang to enable the elevator to deliver the last envelope in the stack 24 to the suction feet 28 of the duplicator 10 as illustrated by an envelope overhang portions shown in FIG. 3.

A stack of envelopes to be printed is stacked in each of the chargers 110, one of which is shown in FIG. 1 by example. The envelopes 24 are stacked on the flange 124 of the plate 122. The chargers 110 are moved, one at a time, toward the feed system of the offset duplicator 10 beneath the media receiving station 26. When pushed forward the plunger 136 of the charger 110 causes the plate 122 to position the stack of envelopes upright between the guide members 30, 32, the beveled edges 31 of the guide members 30, 32 further guiding the envelopes for alignment in the offset duplicator 10. After the chargers 110 are removed the guide member arrangement 16 retains the two adjacent stacks of envelopes in alignment, the forward and rearward central members 34, 30 retaining inward longitudinal sides of the envelopes while the outer members retaining the outward longitudinal sides of the envelopes 24.

As the duplicator 10 is operating, the envelopes are stripped, two at a time, and removed from both adjoining stacks of envelopes 24 simultaneously, by the suction feet 28. As envelopes 24 are removed from the feeding stacks, the elevator 37 is raised. If one stack of envelopes 24 is higher than the other, envelopes 24 will be stripped first off the higher stack 24, until the size of the stacks are approximately equal, at which time the envelopes 24 will then be removed, one at a time, from each stack simultaneously. Since the elevator frame 14 defines windows 20, 22, the elevator 37 can be raised feeding envelopes 24 to the duplicator 10 yet allowing the fixed guide members 30, 32, 34 to pass through the frame 14. The effect is to maintain a support structure for the envelopes keeping the envelopes stacked as they are fed to the offset duplicator 10.

At the delivery region, printed envelopes 72 are delivered in two adjoining stacks. Since the elevator frame 56 defines windows 68, 70, the elevator 37 can be raised and lowered without interference, along the fixed guide members 60, 62 to pass through the windows 68, 70 of the frame 56. The enlarged back jogger 104 and the two back joggers 106 provides a tamping action to each stack to cause the envelopes to be evenly stacked.

Thus, an envelope delivery printing apparatus has been described which allows the efficient multiple simultaneous printing of envelopes on ordinary offset presses. Typically, duplicators allow maximum paper size of 11"×17" (27.9 cm.×43.2 cm.). This is adequate for most envelopes in use. Duplicators similar in structure with larger usable format may still similarly use arrangements for simultaneous printing printing of plural envelopes. Particularly with larger usable wide duplicators, more than two simultaneous stacks may be simultaneously printed. Though primarily for the printing of envelopes, the apparatus described herein may be used for multiple simultaneous duplication of other narrow form stock and the like.

While the invention has been particularly shown and described with reference to particular examples thereof, it will be understood by those skilled in the art that various changes in form and details may be made therein without departing from the spirit and scope of the invention.

What is claimed is:

1. An envelope printing system comprising:

offset duplicator means for receiving sheet media from an upwardly moving stack, impressing an inked image on the sheet media and delivering the sheet media to a stacker, the offset duplicating means defining a printing path and having a media receiving station for stripping the uppermost media from a media stack and presenting the media to the printing path;

feeding means for supplying multiple envelopes simultaneously to the media receiving station of the offset duplicator means, the feeding means having an elevator for progressively supplying sheet media to the media receiving station at a nominally fixed level in alignment with the receiving station for simultaneous presentation of plural envelopes to the printing path;

frame means for supporting envelopes for presentation to the receiving station, the frame means coupled to the elevator of the offset duplicator means, the frame means having envelope bed means for vertically supporting plural envelope stacks in adjacent yet spaced apart relationship to define longitudinal window means between the envelope stacks, the bed means defining a lateral plane and the longitudinal window means for receiving upright guide members normal to the lateral plane of the bed means, the bed means disposed transversely across the frame means;

base means for supporting a plurality of longitudinal upright guide members; and longitudinal upright guide means for entraining in a upright stack envelopes for presentation to the receiving station, the upright guide means extending from the base means for supporting plural stacks of envelopes in adjacent yet juxtaposed relationship, the longitudinal upright guide means extending through the window means, whereby plural uniform stacks of envelopes may be presented to the feeding station, without interference from the envelope bed as the upright guide means pass through the window means.

2. The invention as set forth in claim 1 and comprising:

a stacker bed for building plural envelopes stacks in parallel, juxtaposed relationship;

a stacker base disposed beneath the stacker bed and upright stacker guide members extending from the stacker base for aligning the envelopes delivered to the stacker in the parallel juxtaposed columns, the stacker bed defining stacker bed windows for receiving the upright stacker guide members, whereby the stacker guide members are allowed to pass through the stacker windows of the stacker bed, as the stacker is moved along a vertical plane.

3. The invention as set forth in claim 1 and comprising charger means for receiving a bulk stack of envelopes and delivering a bulk quantity of envelopes to the feedings means, the charger means removably disposed adjacent the media receiving station for receiving a bulk upright stack of envelopes and uniformly delivering the stack of envelopes to a region bounded by the envelope bed means, the media receiving station, and the guide member means.

4. The invention as set forth in claim 1 and in which the guide means comprise interior guide member means for supporting adjacent envelope stacks, remotely spaced apart outer guide member means for inwardly retaining two envelope stacks, and forward guide member means for aligning the positioning of the envelopes reaching the receiving station.

5. The invention as set forth in claim 2 and and in which the duplicator means comprises jogger means disposed above the stacker bed and expansion means coupled to the jogger means for engaging plural envelope stacks.

6. The invention as set forth in claim 5 and in which the guide means are laterally adjustable to conform to envelope width and longitudinally adjustable for envelope length, the guide means comprising bevelled edges for readily receiving the envelopes.

7. The invention as set forth in claim 6 and comprising charger means for delivering a bulk quantity of envelopes to the feeding means, the charger means comprising:

an upright U channel for receiving an envelope stack;

a base for supporting the channel;

movable upright plate means for pushing a stack of envelopes toward the feeding means and envelope flange means for supporting a stack of envelopes, extending from the upright plate means, the upright plate means disposed above the base and within the U channel; and means coupled to the plate means for pushing the plate means towards the feeding means.

8. The invention as set forth in claim 6 and in which the bed means comprising block means having an oblique surface for receiving thickened portions of the envelopes.

9. The invention as set forth in claim 6 and in which the frame comprises a generally rectangular outer portion, including means for supporting plural envelope support plates in spaced apart relationship, the bed comprising envelope support plates disposed in spaced apart relationship and defining rectangular windows for receiving the guide members therethrough without interference.

10. The invention as set forth in claim 9 and in which the longitudinal upright guide means comprises a plurality of upright guide members for maintaining envelopes in a stacked vertical relationship and linkage assembly means for interconnecting the guide members.

11. An envelope printing system comprising:

offset duplicator means for removing sheet material at a feed end, applying a printed impression and delivering sheet material at a delivery end, the offset duplicator means defining a feed end and a delivery end, the offset duplicator means having elevator means for delivering sheet material upward to the feed end;

a frame for supporting plural envelope stacks comprising means for attachment of the frame to the elevator means and planar means horizontally disposed for supporting envelope stacks, the planar means spaced apart to define guide member receiving windows;

a base for supporting a plurality of upright guide members, the base disposed beneath the elevator means;

a plurality of guide members for retaining envelope stacks;

the guide members extending upright from the base, through the guide member receiving windows of the frame, whereby the frame and elevator means are moveable along a vertical axis without interference from the guide members, the guide members laterally bearing on envelope stacks to provide an evenly stacked delivery to the envelope feed end.

12. The invention as set forth in claim 11 and in which the delivery end comprises a receding elevator and comprising:

a delivery base for supporting a plurality of delivery guide members;

a plurality of delivery guide members extending upward from the base including guide members disposed in spaced apart relationship to entrain envelope stacks; a delivery frame coupled to the receding elevator, the frame having a plurality of envelope support means coupled to the frame, spaced apart to define windows for receiving the upright guide members without interference, whereby as the frame is moved along the vertical axis, the windows allow movement of the guide members through the frame adjacent the envelope stacks without interference.

13. The invention as set forth in claim 11 and comprising:

means for movably adjusting the delivery guide members along an axis parallel to the envelope stacks to allow lateral movement of the guide members to accommodate envelopes of different sizes.

14. The invention as set forth in claim 11 and comprising:

charger means for supplying a uniform stack of envelopes, the charger means disposed adjacent the feed means and having plural stacks of envelopes disposed therein and comprising;

support base means for supporting an envelope stack;

channel means for entraining sides of envelope stacks in an upright uniform position;

back plate means for bearing against the width of an envelope stack, the back plate means disposed upright within the channel means; and plunger means coupled to the back plate means for moving a stack of envelopes into a feeding position in engagement with the feed means, whereby an entire stack of envelopes may be quickly loaded into feeding position for juxtaposed simultaneous printing, yet loading of the charger means may occur off line during the printing operation.

15. An envelope printing system comprising:

offset duplicator means for removing sheet material at a feed end, applying a printed impression and delivering sheet material at a delivery end, the offset duplicator means defining a feed end and a delivery end, the offset duplicator means having feed elevator means for delivering sheet material upward to the feed end;

a feed end frame for supporting plural envelope stacks comprising means for attachment of the frame to the feed elevator means and planar means horizontally disposed for supporting envelope stacks the planar means spaced apart to define guide member receiving windows;

a feed end base for supporting a plurality of upright guide members, the base disposed beneath the elevator means;

a plurality of feed end guide members for retaining envelope stacks;

the feed end guide members extending upright from the base, through the guide member receiving windows of the frame, whereby the frame and elevator means are moveable along a vertical axis without interference from the guide members, the guide members laterally bearing on the envelope stacks to provide an evenly stacked delivery to the envelope feed end;

the delivery end comprising a receding elevator and a delivery base for supporting a plurality of delivery guide members;

a plurality of delivery guide members extending upward from the base including guide members disposed in spaced apart relationship to entrain envelope stacks;

a delivery frame coupled to the receding elevator, the frame having a plurality of envelope support means coupled to the frame, spaced apart to define windows for receiving the delivery guide members without interference, whereby as the frame is moved along the vertical axis, the windows of the feed and delivery ends allow movement of the guide members through the frame adjacent the envelope stacks for printing and printed envelope stacks without interference.

16. The invention as set forth in claim 15 and in which the feed end base comprising means for adjusting the positioning of the feed end guide members to compensate for variations in envelope widths for printing.

17. The invention as set forth in claim 16 and in which the delivery end base comprising means for adjusting the positioning of the delivery end guide members to compensate for variations in envelope widths which have been printed.

18. The invention as set forth in claim 16 and in which the planar means comprise a plurality of rectangular plates and the frame comprising an inner support surface for engaging the edges of the rectangular plates, the plates movable along the inner surfaces to compensate for positioning of multiple envelope stacks when disposed on the plates.

19. The invention as set forth in claim 18 and comprising blocks having an oblique surface disposed on each rectangular plate for supporting envelope stacks, the oblique surface for receiving overhanging portions of envelope stacks.

* * * * *